United States Patent [19]

Schwämmle

[11] Patent Number: 4,826,509

[45] Date of Patent: May 2, 1989

[54] DRESSING ROLL

[75] Inventor: Jakob Schwämmle, Weikersheim, Fed. Rep. of Germany

[73] Assignee: WENDT GmbH, Meerbusch, Fed. Rep. of Germany

[21] Appl. No.: 191,414

[22] Filed: May 9, 1988

[30] Foreign Application Priority Data

Aug. 12, 1987 [DE] Fed. Rep. of Germany ..... 3726855

[51] Int. Cl.[4] ..... C09K 3/14

[52] U.S. Cl. ..... 51/298; 51/293; 51/309

[58] Field of Search ..... 51/293, 298, 309

[56] References Cited

U.S. PATENT DOCUMENTS

| | | | |
|---|---|---|---|
| 4,042,347 | 8/1977 | Sioui | 51/298 |
| 4,048,765 | 9/1977 | Samuelson | 51/298 |
| 4,099,934 | 7/1978 | Suzuki et al. | 51/309 |
| 4,150,514 | 4/1979 | Douglass | 51/298 |
| 4,162,900 | 7/1979 | Judd | 51/298 |
| 4,339,896 | 7/1982 | Dennis et al. | 51/298 |
| 4,405,341 | 9/1983 | Jaschek et al. | 51/298 |

*Primary Examiner*—Paul Lieberman
*Assistant Examiner*—Willie J. Thompson
*Attorney, Agent, or Firm*—Dressler, Goldsmith, Shore, Sutker & Milnamow, Ltd.

[57] ABSTRACT

A dressing roll having a peripheral surface comprising diamond grains that are bonded by electroplating in a metal ring, the inner surface of which is readily connected to a cylindrical surface of a roll core as a basic structure. The rigid connection between the metal ring containing the diamond grains and the basic structure consists of a composite material that is composed of solid particles and a plastic binder. The invention also includes the process for producing such a dressing roll.

13 Claims, 1 Drawing Sheet

DRESSING ROLL

Figure 1:
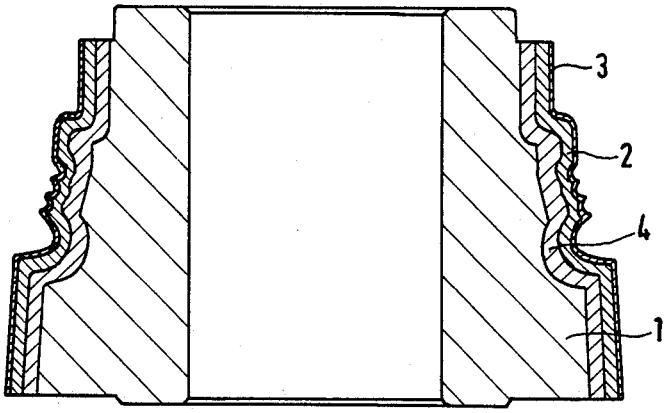

The invention relates to a dressing roll according to the preamble of patent claim 1, and to a process according to the preamble of patent claim 10.

Electroplated diamond dressing rolls are known to comprise a natural or synthetic diamond grain, a nickel coating in which the diamond grains are bonded, a metal of low melting point and a steel basic structure.

The nickel coating is produced by electroplating by the electroforming process. This refers to a ring-shaped element which carries the profile of the dressing roll. This ring is cast to form a unit by filling a cavity between it and the basic structure with a low-melting metal, a bismuth/tin alloy.

In the current process, the problem occurs that it is necessary to cast the bismuth/tin alloys at temperatures around 100° C. In this case, dimensional changes to the highly accurate dressing rolls can occur, the elimination of which requires considerable reworking. A further disadvantage of such dressing rolls is that, if the dressing rolls are not used entirely correctly, the melting points of the bismuth/tin alloys can easily be exceeded, causing detachment of the effective diamond coating from the basic structure.

The invention has the object of achieving, in dressing rolls of the construction mentioned in the preamble to claim 1 and in processes for the production thereof, bonding between the metal ring containing the diamond grains and the basic structure of a dressing roll at lower temperature and achieving significantly greater temperature stability and accuracy of the dressing roll.

The invention achieves this object by means of a dressing roll having the features contained in the characterizing part of patent claim 1 and by means of the process steps in the characterizing part of patent claim 10.

By means of these features and steps, the above-described disadvantages are eliminated by carrying out the bonding at curing temperatures in the region of room temperature and by the fact that the plastics used make possible significantly greater temperature stability and accuracy than the metal alloys used hitherto.

The solid particles can have different grain shapes, for example they can be irregular, dendritic or spherical. It is also possible to mix and use solid particles of different grain shapes or different grain sizes. Suitable metals for the solid particles are bronze, brass or stainless steel.

Suitable binders are synthetic resins of various systems, but two-component epoxy resins, and where appropriate also two-component polyurethane resins, which contain a mineral or metallic filler are preferably used. Depending on the type of the solid particles used, it is also possible to employ unfilled resins. By correct matching of the solid particles and binders, the properties necessary for use of these composite materials, such as shape stability, mechanical strength and temperature resistance, can be adjusted to the optimum.

The solid particles are introduced into the cavity between the metal ring and the basic structure. The solid particles cause bonding between the metal ring and the basic structure at the grain boundaries. The cavities between the solid particles are preferably filled by infiltration, i.e. by sucking in or forcing in, with one of the binders mentioned.

Figure 2:
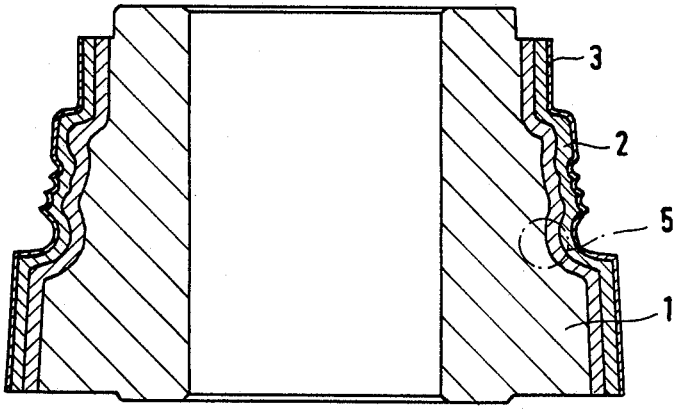
Figure 3:
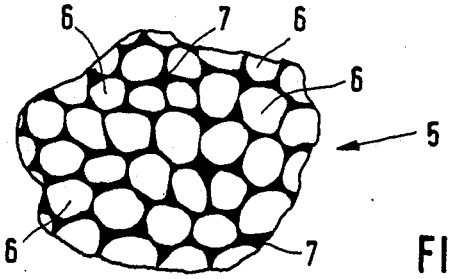

The invention is described in greater detail below by means of the example of a known dressing roll and a dressing roll according to the invention, with reference to the drawing, in which:

FIG. 1 shows a central longitudinal section through a diamond dressing roll of known design, FIG. 2 shows a central longitudinal section through a diamond dressing roll according to the invention, and FIG. 3 shows the detail circled in FIG. 2 on an enlarged scale.

FIG. 1 shows a known diamond dressing roll which comprises a basic structure 1 and a metal ring 2 which has been produced by the known electroforming process and into which diamond grains 3 comprising natural or synthetic diamond grains have been bonded. The metal ring 2 generally comprises nickel and serves as the coating, provided with diamond grains 3, of the ring-shaped working surface of the diamond dressing roll. The metal ring 2 and the basic structure 1 are cast to form a solid unit by means of a bismuth/tin alloy 4 whose melting point is about 100° C.

FIG. 2 illustrates a diamond dressing roll according to the invention, the same parts being given the same reference symbols. It can be seen that the diamond dressing roll in FIG. 2 differs from the known design in FIG. 1 in that the metal ring 2 incorporating the diamond grains 3 is bonded to the basic structure 1 by a composite material 5 which comprises preferably metallic solid particles 6 and a two-component synthetic resin 7, preferably an epoxy resin or alternatively a polyurethane resin, which is, if appropriate, augmented by, preferably, mineral fillers or alternatively metallic fillers. This composite material 5 is represented more clearly in FIG. 3. Metallic solid particles 6 of different sizes can be seen which are bonded rigidly to one another by the cured two-component synthetic resin 7. In a preferred manner, mineral fillers, such as silicates, or metallic fillers, such as metal powders, are added to the synthetic resin before the use thereof in order, inter alia, to significantly increase the thermal stability and mechanical strength of the composite material. In this way, it is possible to increase the thermal stability to temperatures of about 250° C. so that, besides the temperature resistance, the shape stability and the mechanical strength are ensured to a great extent over a significantly greater temperature range. It is possible for the solid particles to represent a mixture of different grain shapes and/or, in addition, grain sizes. Thus, the metal particles may have a spherical, nodular, irregular or dendritic shape. The grain size of the metal particles is preferably between 0.15 mm and 1.5 mm.

The mixing of the metallic solids with the plastic binders is carried out by clamping the parts of the diamond dressing roll which are to be bonded in a device in the correct positions to one another and completely filling the ring-shaped cavity by incorporating, forcing in or sucking in the plastic binder after introducing the metallic solids.

It can thus be seen that, through the diamond dressing roll according to the invention and the process proposed for the production thereof, bonding is achieved between the nickel coating containing the bound diamond grains and the basic structure of the diamond dressing roll which is more economic, but at the same time has a greater temperature resistance, shape stability, mechanical strength and accuracy.

In an illustrative embodiment of a diamond dressing roll, the peripheral profile of the steel basic structure has a maximum diameter of 130 mm. The nickel ring containing the bound diamond grains has a thickness of 2 to 2.5 mm and is rigidly bonded to the roll core by means of a 2 to 4 mm thick layer of the composite material comprising solid particles and plastic binder. This diamond dressing roll has a greater temperature resistance, shape stability, mechanical strength and accuracy than comparable diamond dressing rolls in which the metal ring has been cast onto the roll core by means of a bismuth/tin alloy to form a unit.

I claim:

1. A dressing roll whose peripheral surface comprises diamond grains which are bonded by electroplating in a metal ring whose inner ring surface is rigidly connected to the cylindrical surface of a roll core as the basic structure, wherein the rigid connection between the metal ring containing the diamond-grains and the basic structure comprises a composite material which is composed of solid particles and a plastic binder.

2. A dressing roll as claimed in claim 1, wherein the solid particles have different shapes.

3. A dressing roll as claimed in claim 1, wherein the sizes of the solid particles are different.

4. A dressing roll as claimed in claim 3, wherein the grain size of the sblid particles is between 0.15 mm and 1.5 mm.

5. A dressing roll as claimed in claims 1, 2, 3, or 4, wherein the solid particles comprise metal.

6. A dressing roll as claimed in claim 1, wherein the binder is a two-component synthetic resin.

7. A dressing roll as claimed in claims 1 or 6, wherein the plastic binder essentially comprises an epoxy resin.

8. A dressing roll as claimed in claims 1 or 6, wherein the plastic binder essentially comprises a polyurethane resin.

9. A dressing roll as claimed in any one of claims 1 or 6, wherein the binder contains mineral and/or metallic fillers.

10. A process for the production of the dressing roll according to any one of claims 1, 2, 3, 4, or 6 in which process a roll core as the basic structure and a metal ring, having diamond grains bonded by electroplating, surrounding the former at a distance to form an annular space are connected to form a unit by filling the annular space with a binder, wherein a composite material made from solid particles and a plastic binder is used by means of which the annular space between the metal ring having diamond grains and the basic structure is filled.

11. A process as claimed in claim 10, wherein the filling with the plastic binder of the annular space between the metal ring containing the diamond grains and the basic structure takes place by means of infiltration after positionally accurate clamping of the basic structure and the metal ring in a device and after filling the annular space with the metallic solid particles.

12. A process as claimed in claim 10, wherein the plastic binder used is a two-component synthetic resin, such as an epoxy resin or polyurethane resin.

13. A process as claimed in claim 10 wherein mineral and/or metallic fillers are added to the synthetic resin before crosslinking thereof.

* * * * *